United States Patent [19]

de Bruyne

[11] Patent Number: 4,534,656

[45] Date of Patent: Aug. 13, 1985

[54] FLOATING MAGNETIC STIRRER WITH DRIVING GUIDE ROD

[75] Inventor: Norman A. de Bruyne, Princeton, N.J.

[73] Assignee: Techne Corporation, Princeton, N.J.

[21] Appl. No.: 502,618

[22] Filed: Jun. 7, 1983

[51] Int. Cl.[3] ..... B01F 13/08

[52] U.S. Cl. ..... 366/247; 366/273; 366/286; 366/306

[58] Field of Search ..... 366/241, 242, 247, 256, 366/273, 274, 279, 286, 306, 332

[56] References Cited

U.S. PATENT DOCUMENTS

| | | | |
|---|---|---|---|
| 1,430,362 | 9/1922 | Devereux | 366/306 X |
| 2,556,854 | 6/1951 | Spears et al. | 366/273 X |
| 2,958,517 | 11/1960 | Harker et al. | 366/273 X |
| 3,572,651 | 3/1971 | Harker | 366/273 X |
| 3,622,129 | 11/1971 | Mazowski | 366/274 X |
| 3,649,465 | 3/1972 | Scharf et al. | 366/273 X |
| 4,310,253 | 1/1982 | Sada et al. | 366/273 |
| 4,382,685 | 5/1983 | Pearson | 366/306 X |

FOREIGN PATENT DOCUMENTS

| | | | |
|---|---|---|---|
| 2449473 | 10/1980 | France | 366/274 |

*Primary Examiner*—Philip R. Coe

*Attorney, Agent, or Firm*—Irvin A. Lavine

[57] ABSTRACT

A magnetic stirrer apparatus for culture medium and other liquids comprises a flask having a floating stirrer in it; a driving guide rod extends downwardly into the flask, and has a sliding drive connection with the floating stirrer. The driving guide rod is suspended from a bearing on the underside of the flask closure, and carries a driven magnet, which is magnetically coupled with a motor-driven magnet on the outside of the closure.

19 Claims, 3 Drawing Figures

FLOATING MAGNETIC STIRRER WITH DRIVING GUIDE ROD

TECHNICAL FIELD

The present invention relates to a magnetically driven stirrer apparatus, in which the stirrer is buoyant.

BACKGROUND ART

Apparatus for stirring liquid materials, including culture mediums, have long been known. For example, Scharf et al. U.S. Pat. No. 3,649,465 provides a flask or vessel having an opening at its upper portion, with a closure for the opening, having a spindle extending therethrough, the spindle at its lower end having a magnetic stirrer, with a shroud extending in surrounding relationship to the spindle. The stirrer is driven magnetically by a driving magnet, and the magnetic stirrer, located at the bottom of the flask, may be adjusted through a limited vertical range by vertically adjusting the spindle within the limits permittted by the shroud.

Harker et al. U.S. Pat. No. 2,958,517 provides a flask having a rod guided in a bearing in a closure for the flask, the rod having at its lower end a magnetic impeller, which engages the bottom of the flask, the magnetic impeller being driven by a magnetic stirring apparatus on which the flask is held, the apparatus including an electric motor having a shaft driving a magnet which is magnetically coupled to the magnet within the flask.

Harker U.S. Pat. No. 3,572,651 provides a flask having a closure provided with a bearing on its underside, the bearing supporting a spindle having at its lower end, near the bottom of the flask, a magnetic stirrer, the magnetic stirrer being driven by a conventional magnetic driving apparatus.

Mazowski U.S. Pat. No. 3,622,129 also discloses a magnetic stirrer apparatus, in which a flask has an opening, a closure for the opening with a rod extending through the opening, the rod supporting at its lower end a magnetic stirrer, and the rod being adjustable, vertically, in the closure, so as to position the stirrer at different depths in the liquid in the flask.

Sada et al. U.S. Pat. No. 4,310,253 discloses an apparatus in which a vessel containing a body of liquid has floating, magnetic particles which are caused to rotate by a rotating magnetic field, to rotate the interface between, for example, a liquid and a gaseous body in the vessel.

The prior art in which the stirrer is submerged in the liquid was subject to various defects and deficiencies, including constructions which were difficult to clean and which did not have sufficient cell proliferating action. In some cases, obstructions were provided to the liquid motion by the stirrers, or stirring action unsuitably vigorous for cell culture was required to insure complete stirring action.

DISCLOSURE OF INVENTION

The present invention is directed to a magnetic stirrer apparatus in which the stirrer is buoyant, and thereby floats on the surface of the liquid, preferably liquid culture medium, which is to be stirred. The stirrer is caused to be rotated, generally on the vertical axis of the flask, and is enabled to change its elevation, relative to the bottom of the flask, as the level of liquid in the flask may be changed. The floating stirrer is restricted by a guide rod to rotational movement, and to vertical movement as the liquid level may change; a magnetic drive is provided to cause rotational movement of the stirrer, to thereby cause stirring action of the entire body of liquid in the flask, due in part to viscous drag. The guide rod is preferably a non-circular driving guide rod which is suspended from the underside of a closure provided for the upper opening of the flask, and a magnetic drive apparatus causes rotation of the driving guide rod, the apparatus comprising a magnet on the driving guide rod within the flask, and a motor-driven magnet carried on the exterior of the closure or cover for the flask. A rotational driving and axially sliding movement is provided between the driving guide rod and the floating stirrer, preferably provided by the driving guide rod being of hexagonal or other polygonal or non-circular transverse cross section, and the floating stirrer having an opening therethrough congruent with and slightly larger than the driving guide rod.

Among the advantages of the present invention apparatus are the restriction of the floating stirrer to rotational movement about a generally fixed axis, without danger of the stirrer coming into contact with the walls of the vessel or flask, wherein possible crushing of cells might occur. Further, the present apparatus is relatively easy to clean, and provides for improved circulation, thereby providing for a high level of cell proliferation. There is no obstruction to the stirrer and the present apparatus has the advantage of relying upon viscous drag to yield necessary secondary motion, that is, vertical circulating motion of the liquid material, which provides for enhanced cell proliferation: the vertical, secondary motion is in addition to the primary horizontal rotary motion obtained directly from the rotation of the floating stirrer in the horizontal plane.

MODES FOR CARRYING OUT THE INVENTION

Figure 1:
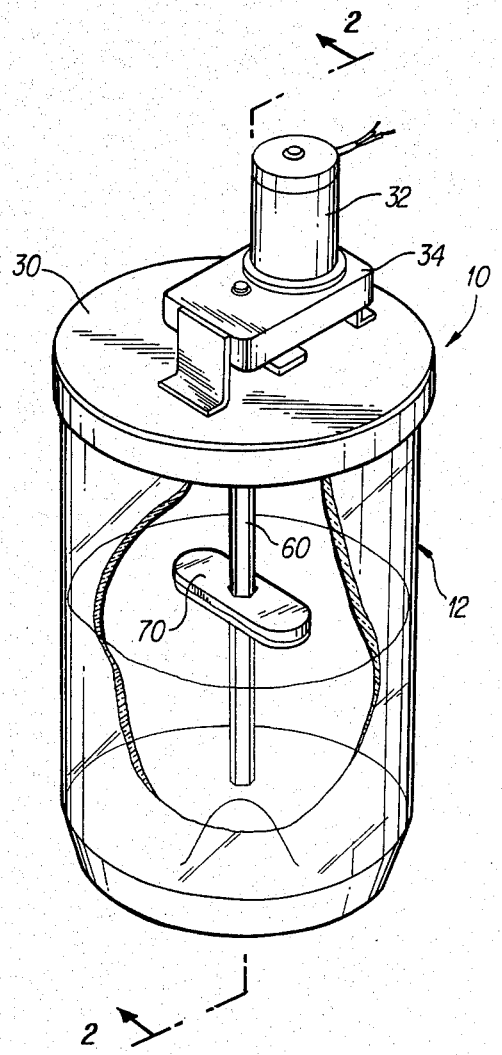
FIG. 1 is a perspective view of a floating stirrer with driving guide rod in accordance with the present invention.

Referring now to the drawings, wherein like or corresponding reference numerals are used to designate like or corresponding parts throughout the several views, there is shown in FIG. 1 a magnetic stirrer apparatus generally designated 10, comprising a flask 12 with a cover or closure 30 thereon, the cover carrying an electric motor 32 mounted on a housing 34. Within the flask 12 there may be seen a floating stirrer 70 and a driving guide rod 60.

Figure 2:
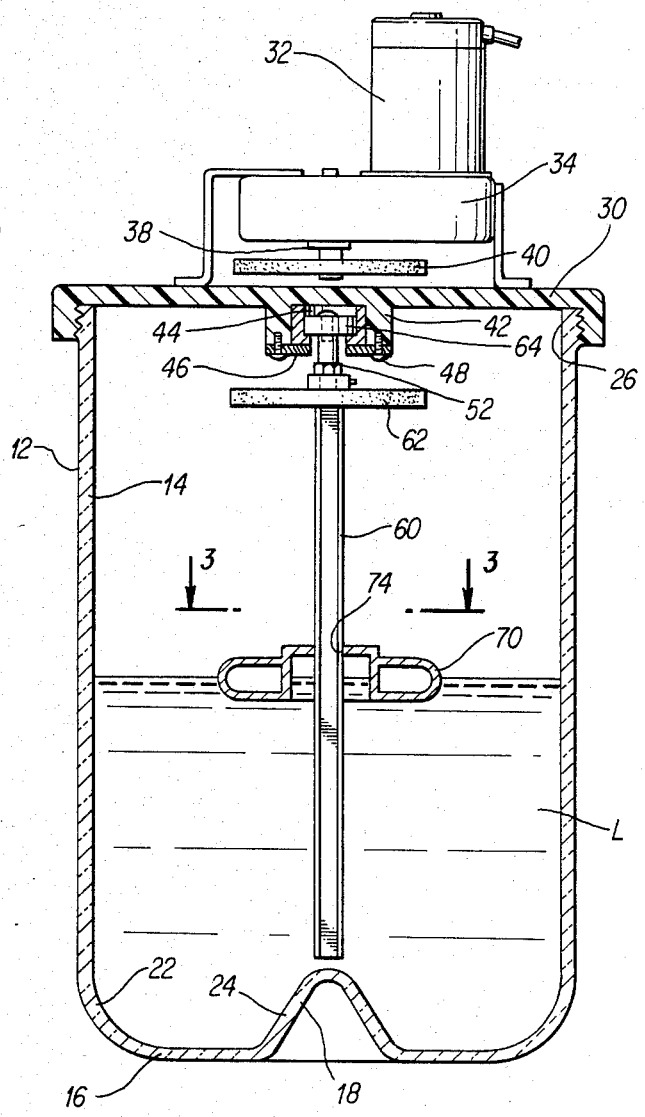
FIG. 2 is a cross-sectional view taken on the line 2—2 of FIG. 1.

Referring now to FIG. 2, the flask 12 is shown having side walls 14, preferably cylindrical, and a bottom wall 16 having in the center thereof a protrusion 18 of generally rounded, conical configuration. Where the bottom 16 joins the side wall 14, there is a rounded portion or fillet 22, and a similar rounded portion or fillet 24 is provided at the juncture of the bottom wall 16 and the upstanding conical protrusion 18. Thus, the flask 12 as described is made in accordance with Pearson U.S. Pat. No. 4,382,685, issued May 10, 1983. By this construction, upon rotation of the liquid culture medium L in the flask 12, there are no stagnation zones, or areas, so that all the liquid L in the flask 12 is caused to circulate, thereby providing enhanced cell growth, if the liquid L is a liquid culture medium.

The flask 12 has an opening 26 at its upper end, which is closed by the cover or closure 30: a screw threaded connection is shown between the closure 30 and the side walls 14 of flask 12, but it will be understood that other forms of closures, and connections between the closure and the flask may be provided.

The motor 32 is shown, connected to a housing 34 in which there are reduction gears, there being an output shaft 38 which drives a driving magnet 40.

Figure 3:
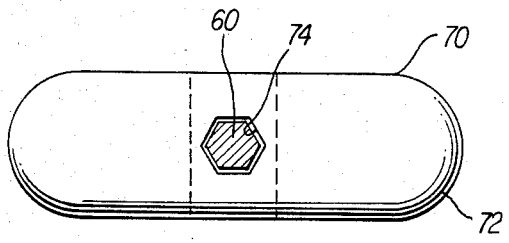
FIG. 3 is a cross-sectional view taken on the line 3—3 of FIG. 2.

On the underside of the closure 30 is a hollow boss 42 having a bearing element 44 therein, and held by a plate 46 fastened by screws 48, the plate 46 having a central opening 52 therethrough. A driving guide rod 60 is provided, being of hexagonal transverse cross section as shown in FIG. 3, and having near its upper end a magnet 62, magnetically coupled to the magnet 40. At its upper end, the driving guide rod 60 terminates in an enlarged bearing head 64 which rests on and engages the bearing element 44 to provide for an antifrictional rotational movement of the driving guide rod 60 about its longitudinal axis, which in normal operations will be vertical. The lower end 66 of the driving guide rod 60 terminates above the upper most portion of the upstanding conical protrusion 18, so that there is a gap between them, in order to avoid contact and thereby any crushing action which will occur if the end 66 of driving guide rod 60 rested upon the upstanding conical protrusion 18.

A floating magnetic stirrer 70 is provided, being in the shape, as shown in FIG. 3, of an elongate body, having rounded ends 72, the floating stirrer 70 having a length less than the internal diameter of the flask 12. Floating stirrer 70 is of less specific gravity than the liquid L, and thereby floats on it, and is provided with an opening 74 therethrough. The driving guide rod 60 passes through the opening 74 in floating stirrer 70, and opening 74, as shown in FIG. 3, is congruent with the shape of the driving guide rod 60. There is provided some clearance between the driving guide rod 60 and the walls of floating stirrer 70 which define the opening 74 thereof, so that there results a rotational driving movement of stirrer 70 by the driving guide rod 60, as well as axial movement between stirrer 70 and driving guide rod 60 when the level of the liquid L is changed. In addition, the driving guide rod 60 restricts the movement of stirrer 70 to the vertical direction and to rotational movement, generally about the axis of driving guide rod 60. As shown in FIG. 2, the walls defining opening 74 are above the surface of the liquid L, to prevent crushing of microcarriers between the floating stirrer 70 and the hexagonal driving guide rod 60.

In operation, with the closure 30 removed, the stirrer 70 is placed upon the driving guide rod 60, and liquid L, such as a liquid culture medium, is placed into the flask 12. The closure 30 is then placed on flask 12, and the motor 32 is energized, thereby causing rotation of magnet 40: due to magnetic coupling, the magnet 62 on driving guide rod 60 is thereby caused to rotate, and this rotates driving guide rod 60 and the floating stirrer 70.

With the present apparatus, the driving of the stirrer 70 is positive, and the circulation within the flask 12 is complete, without stagnation zones or areas. The enhanced circulation provides for enhanced cell growth, and there is little, if any, harmful effect upon the liquid material being stirred.

It will be obvious to one skilled in the art that various changes may be made without departure from the spirit of the invenion, and therefore the invention is not limited to that shown in the drawings, and described in the specification but only as indicated in the appended claims.

I claim:

1. A magnetic stirrer apparatus for stirring liquid culture medium comprising:
   (a) a flask having an opening in the upper part thereof,
   (b) a closure for said opening,
   (c) means for generating horizontal rotary motion and vertical circulating motion of liquid culture medium in said flask from the liquid surface substantially to the bottom of the flask and thence upwardly comprising:
      (i) a driving guide rod in said flask,
      (ii) a floating stirrer in said flask,
      (iii) means for coupling said rod and stirrer for relative axial, non-rotational movement,
      (iv) means for supporting said driving guide rod for axial rotational movement in said flask, and
      (v) means for axially rotating said driving guide rod,
   (d) said apparatus being free of means for generating turbulent flow in said flask.

2. The magnetic stirrer apparatus of claim 1, wherein said coupling means comprises a non-circular opening through said stirrer, said driving guide rod having a congruent transverse cross-sectional shape.

3. The magnetic stirrer apparatus of claim 2, said opening and said driving guide rod in cross section being polygonal.

4. The magnetic stirrer apparatus of claim 3, said opening and said driving guide rod cross section being hexagonal.

5. The magnetic stirrer apparatus of claim 1, said means for supporting said drive rod comprising a bearing on the underside of said closure.

6. The magnetic stirrer apparatus of claim 5, said driving guide rod having a lower end spaced from the bottom of said flask.

7. The magnetic stirrer apparatus of claim 1, said driving guide rod having a lower end spaced from the bottom of said flask.

8. The magnetic stirrer apparatus of claim 1, said means for rotating said driving guide rod comprising magnetic coupling means on said driving guide rod and on the outside of said flask.

9. The magnetic stirrer apparatus of claim 8, wherein a portion of said magnetic coupling means is on said closure.

10. The magnetic stirrer apparatus of claim 1, said means for rotating said driving guide rod comprising a driven magnet fixed to said driving guide rod in adjacent spaced relation to said closure, a driving magnet rotatably supported on said closure exteriorly thereof, and means for rotating said driving magnet.

11. The magnetic stirrer apparatus of claim 1, said flask having a bottom and cylindrical side walls, and an upstanding protrusion extending upwardly from the vessel bottom and spaced from said side walls thereby forming an annular trough in the bottom portion of said flask.

12. The magnetic stirrer apparatus of claim 1, said coupling means comprising said driving guide rod being of polygonal cross-section and passing through a congruent opening in said floating stirrer, said supporting means comprising a bearing on the underside of said closure, said driving guide rod supported in said bearing, and said rotating means comprising a magnet on said driving guide rod and a magnet on said cover, and means for rotating said last mentioned magnet.

13. The magnetic stirrer apparatus of claim 12, said flask having a bottom and cylindrical side walls, and an upstanding protrusion extending upwardly from the vessel bottom and spaced from said side walls thereby forming an annular trough in the bottom portion of said flask.

14. A magnetic stirrer apparatus comprising:

(a) a vessel having bottom and side walls, and an opening, (b) closure means for said opening having (i) a bearing on the underside thereof, and (ii) a rotatable magnet on the upper side thereof, (c) means for drivingly rotating said magnet, (d) stirrer means for causing horizontal rotary motion and vertical circulating motion consisting solely of a floating stirrer in said vessel having a non-circular opening therethrough, and (e) a driving guide rod extending downwardly into said vessel having its upper end supported by said bearing and its lower end spaced from the bottom wall of said vessel, said driving guide rod being of non-circular cross section, congruent with said opening in said floating stirrer, said driving guide rod passing through said opening in driving relationshp and with clearance sufficient to enable said floating stirrer to move along said driving guide rod.

15. The magnetic stirrer apparatus of claim 14, said flask having a bottom and cylindrical side walls, and an upstanding protrusion extending upwardly from the vessel bottom and spaced from said side walls thereby forming an annular trough in the bottom portion of said flask.

16. A magnetic stirrer apparatus comprising:

(a) a vessel having an opening at the upper part thereof, (b) a closure for said opening, (c) stirrer means in said vessel consisting solely of floating stirrer means for generating horizontal rotary motion and vertical circulating motion of liquid in said vessel, and (d) means for rotating said stirrer means and for restricting movement of said stirrer means to rotary movement and to substantially vertical movement with change in liquid level in said vessel.

17. The magnetic stirrer apparatus of claim 16, said last mentioned means comprising a rod extending into said vessel, said floating stirrer means having an opening therethrough, and said rod extending through said opening with sufficient clearance to permit movement of said stirrer along said guide rod.

18. The magnetic stirrer apparatus of claim 17, said last mentioned means further comprising means for rotating said rod, and means for drivingly connecting said rod and said floating stirrer means.

19. The magnetic stirrer apparatus of claim 1, said floating stirrer being the sole stirrer in said flask.

* * * * *